US008397617B2

(12) United States Patent
Shirts et al.

(10) Patent No.: US 8,397,617 B2
(45) **Date of Patent: *Mar. 19, 2013**

(54) ADAPTER FOR CONVERTING A MAGAZINE-FED FIREARM TO USE LINKED AMMUNITION

(76) Inventors: Darrell E. Shirts, Salt Lake City, UT (US); Darren Saunders, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/367,738

(22) Filed: Feb. 7, 2012

(65) Prior Publication Data

US 2012/0204710 A1 Aug. 16, 2012

Related U.S. Application Data

(63) Continuation of application No. 12/414,623, filed on Mar. 30, 2009, now Pat. No. 8,136,440.

(60) Provisional application No. 61/050,020, filed on May 2, 2008.

(51) Int. Cl.
*F41A 9/00* (2006.01)

(52) U.S. Cl. ..... 89/33.14; 89/33.2

(58) Field of Classification Search ..... 89/33.01, 89/33.04, 33.14, 33.16, 33.17, 33.2, 33.25, 89/33.5

See application file for complete search history.

(56) References Cited

U.S. PATENT DOCUMENTS 3,136,213 A * 6/1964 Reed ..... 89/33.25
4,676,138 A * 6/1987 Thompson et al. ..... 89/33.14
7,568,421 B2 * 8/2009 Cummings ..... 89/33.2

* cited by examiner

*Primary Examiner* — Gabriel Klein
(74) *Attorney, Agent, or Firm* — Bateman IP

(57) ABSTRACT

An ammunition feed adapter and method of use is provided that converts a semi-automatic or fully automatic firearm from a magazine-fed firearm into a belt-fed firearm enabling the firearm to be used as a sustainable source of firepower. Modification of a soldier's standard issue automatic or semi-automatic rifle into a belt-fed firearm increases the options for strategic maneuvering of a combat unit on the field of battle by overcoming the limitations of traditional sources of sustained firepower, such as a Squad Automatic Firearm.

18 Claims, 16 Drawing Sheets

ADAPTER FOR CONVERTING A MAGAZINE-FED FIREARM TO USE LINKED AMMUNITION

PRIORITY

The present application is a continuation of U.S. patent application Ser. No. 12/414,623, filed Mar. 30, 2009, now U.S. Pat. No. 8,136,440, which is incorporated herein in its entirety, and claims priority to U.S. Provisional Patent Application No. 61/050,020, filed May 2, 2008, which is incorporated herein by reference in its entirety.

FIELD

The present invention relates to adapters for firearms. More specifically, the present invention relates to an adapter for modifying a firearm, designed to accept a magazine, to accept cartridges from an ammunition belt so as to provide the firearm with an increased supply of ammunition without requiring the changing of magazine.

BACKGROUND

When deployed in the field, soldiers are often faced with situations where a means of sustained firepower is desirable to deal with a specific threat on the battlefield. The traditional means of such firepower is a Squad Automatic Weapon (SAW). A SAW is a dedicated belt-fed gun which is configured to fire in a fully automatic mode for a prolonged length of time. A combat unit's source of sustained firepower is a key consideration when making strategic choices about how to best defend a position or otherwise maneuver.

However, a particular combat unit may not even have a SAW assigned to it. Or, when a unit has been assigned a SAW, the soldiers operating it may not be able to utilize the weapon effectively. A typical reason why the SAW has limited effectiveness is because the cartridge belts used to feed the SAW are distributed among several members of the unit, and those unit members can become separated from the SAW's operators. When the SAW's effectiveness is limited, the unit must rely on the automatic and semi-automatic magazine-fed firearms carried by individual members of the squad in order to maneuver. The lack of sustained firepower limits the unit's effectiveness in the field and jeopardizes the lives of soldiers.

There are several other reasons why a combat unit may be unable to properly utilize its SAW. First, the SAW's weight, size, and the number of personnel it may require for operation create problems. These characteristics of the SAW make adjusting a defensive perimeter in response to changing situations difficult. Overall, the SAW's unwieldiness limits its strategic use in response to the large variation in circumstances encountered on the battlefield. For example, if three soldiers are carrying ammunition for the SAW and they come under hostile fire, it is common for them to have to throw ammunition to the soldier operating the SAW while avoiding being shot by the enemy. If the ammunition does not make it to those operating the SAW, the SAW may quickly run out, leaving the soldiers to rely on their rifles or other light firearms.

Second, it is not uncommon for an enemy to target the SAW in an initial attack. A sniper, for example, appreciates that the SAW can cause considerable damage to his or her fellow soldiers. Thus, the soldier holding the SAW will often be the initial target of the sniper, hoping to deprive the unit of its automatic firearm, and its suppressive fire capabilities, when hostilities begin. If that soldier is hit, the squad is placed at a significant disadvantage in an ensuing fire-fight, especially if other soldiers are under fire and cannot make it to the SAW.

Other factors that limit the SAW's use are: its complexity and need for special training to use; ammunition is often distributed throughout the unit and therefore unavailable when individual unit members become separated; and a stationary firearm requires a more defined position. In the absence of a source of sustained firepower, such as a SAW, the combat unit must rely on the semi-automatic and fully automatic firearm carried by the individual members of the unit when planning strategic maneuvering on the battlefield. Additionally, the SAW is generally heavier and more difficult to maneuver, and includes a spare barrel and ammunition above the amount carried by a rifleman.

The automatic or semi-automatic firearms carried by the individual soldiers are fed by magazines that typically hold 20-30 rounds of ammunition. If the firearm is a full automatic, the firearm will often be able to empty the entire magazine within a matter of a few seconds. Thus, a soldier may attempt to move from cover and fire only to find out that the magazine has just run out of ammunition, or runs out while the soldier is still moving.

To limit such situations, some automatic firearms will have a "burst" mode, wherein the firearm will shoot a number of bullets, typically three, with each pull of the trigger. However, in a fire-fight, burst mode may be inadequate to deal with the situation. Rather, a soldier may wish to be able to use a firearm in a full automatic mode for more than three or four seconds at a time. A firearm which is capable of firing 400 rounds per minute is significantly less effective than it could be if the user must change the magazine 12-15 times to fire that many rounds.

To overcome the problem of a continuous need to change magazines, a SAW is belt-fed. A belt may hold many times as many rounds as a magazine and belts often can be attached to one another to provide a virtually endless supply of ammunition. Most firearms carried by the other members of the squad, however, are designed to operate using magazines and will not accept belt-fed ammunition.

Thus there is needed a means for providing a combat unit with sustained firepower which allows the unit to immediately and effectively respond to the constantly changing situations on a battlefield. More specifically, there is a need for a system for the rapid conversion of a magazine-fed firearm into a belt-fed firearm.

SUMMARY

Embodiments of an adaptor to provide for modifying a firearm to accept belt-fed ammunition, and related methods, are disclosed.

In some embodiments, an ammunition feed adapter for converting a magazine-fed firearm is provided to use an ammunition belt to provide a continuous source of ammunition. The ammunition feed adapter may be relatively lightweight, easy to use and manufacture, and can be designed for use with a variety of magazine-fed firearms.

According to some embodiments, an ammunition feed adapter may quickly modify firearms that are designed to receive cartridges from a magazine into a firearm that can receive ammunition from a linked ammunition belt. Magazine-fed firearms modified with the ammunition feed adapter of the present invention are converted into a source of sustained firepower and allow multiple members of a squad to operate in a full automatic mode for much longer than a magazine will allow. In some embodiments, no modification to the firearm may be needed to use the feed adaptor.

According to another embodiment, the ammunition feed adapter may use only the recoil of the host firearm's action as a source of mechanical energy to provide a continuous feed of ammunition to said firearm.

According to another embodiment, the ammunition feed adapter may be connected to the host firearm through a cartridge lift follower body assembly in the same manner in which a ammunition magazine would be connected to the same firearm. The cartridge lift follower body assembly introduces a de-linked cartridge from the ammunition belt into the host firearm's firing mechanism.

According to other embodiments, the ammunition feed adapter may receive cartridges from an ammunition belt using a belt puller assembly. The belt puller assembly positions a linked cartridge for entry into the cartridge lift follower body. The action of the belt puller assembly is coupled to, and driven by, the mechanical force generated by the host firearm's action.

Similarly, cartridges from the ammunition belt that are received by the belt puller assembly and transferred to the cartridge lift follower body assembly, may be de-linked by a de-linker assembly. The de-linker assembly is also coupled to, and driven by, the mechanical force generated by the host firearm's action.

In other embodiments, the mechanical force supplied to the belt puller assembly and the de-linker assembly may be transferred through and coordinated by an operating rod assembly and timing plate assembly respectively. The operating arm assembly may be attached to the host firearm's action, such as a bolt mechanism. Manually charging of the firearm or discharge of a cartridge, i.e. the opening and closing of the firearm's action, moves the operating arm assembly forwards and backwards, providing the mechanical energy for the operation of the belt puller assembly. In some embodiments, the operating arm assembly can coordinate the forward and backwards movement of the de-linker assembly.

In addition, according to another embodiment, the operating arm assembly transfers the mechanical energy from the host firearm's action to the timing plate assembly. In turn the timing plate assembly drives and coordinates the actions of the belt puller assembly and, additionally, the introduction of a cartridge by the cartridge lift assembly. Also, an optional forward firearm mount assembly can be used to further stabilize the ammunition feed adapter during use.

In accordance with still another embodiment, the ammunition feed adapter may be transferred from firearm to firearm. Thus, for example, if the ammunition feed adapter is being used with one automatic firearm and the barrel of the firearm begins to overheat, the ammunition feed adapter can be transferred to another firearm to sustain continued automatic fire capability.

These and other aspects of embodiments of an ammunition feed adapter, and related methods, are shown and described in the following figures and related description.

BRIEF DESCRIPTION OF THE DRAWINGS

Various embodiments of the present invention are shown and described in reference to the numbered drawings wherein:

FIG. 4F(d) shows a perspective view of one embodiment of the belt puller arms;

It will be appreciated that the drawings are illustrative and not limiting of the scope of the invention which is defined by the appended claims. The embodiments shown accomplish various aspects and objects of disclosed ammunition feed adaptors and associated methods. It is appreciated that it is not possible to clearly show each element and aspect of every possible embodiment in a single figure, and as such, multiple figures are presented to separately illustrate the various details in greater clarity. Similarly, not every embodiment need accomplish all advantages or features of the present invention. Finally, the dimensions, tolerances and hardness of the materials used to construct the ammunition feed adapter described herein may vary due to the caliber and type of firearm.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
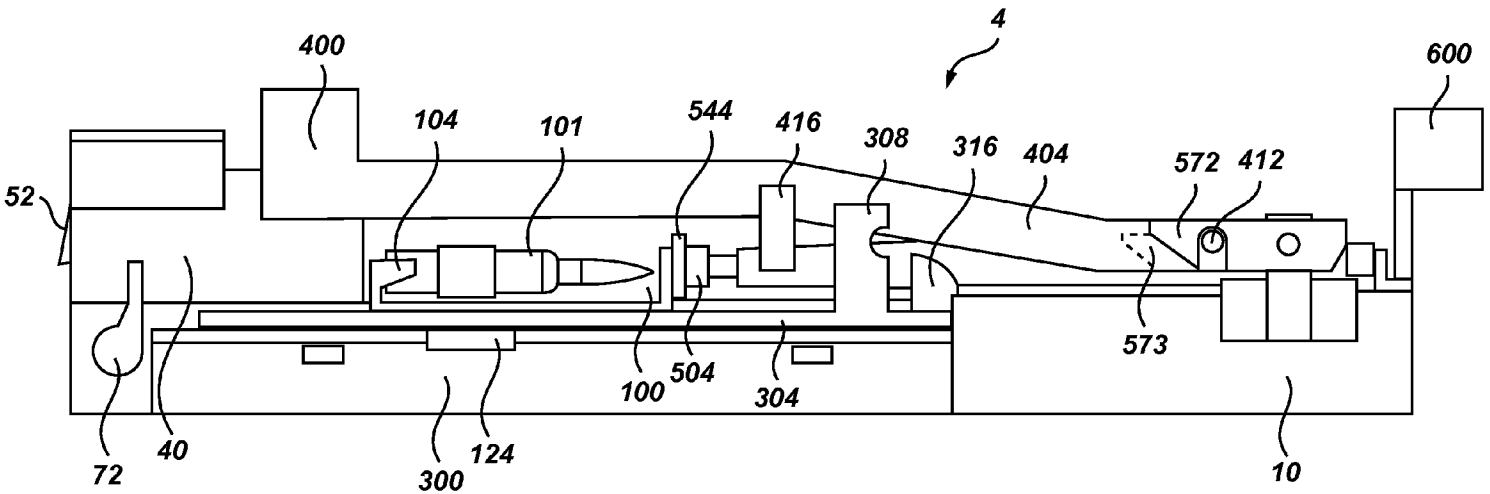
FIG. 1 shows a side view of one embodiment of the ammunition feed adapter according to the present invention.
Figure 2:
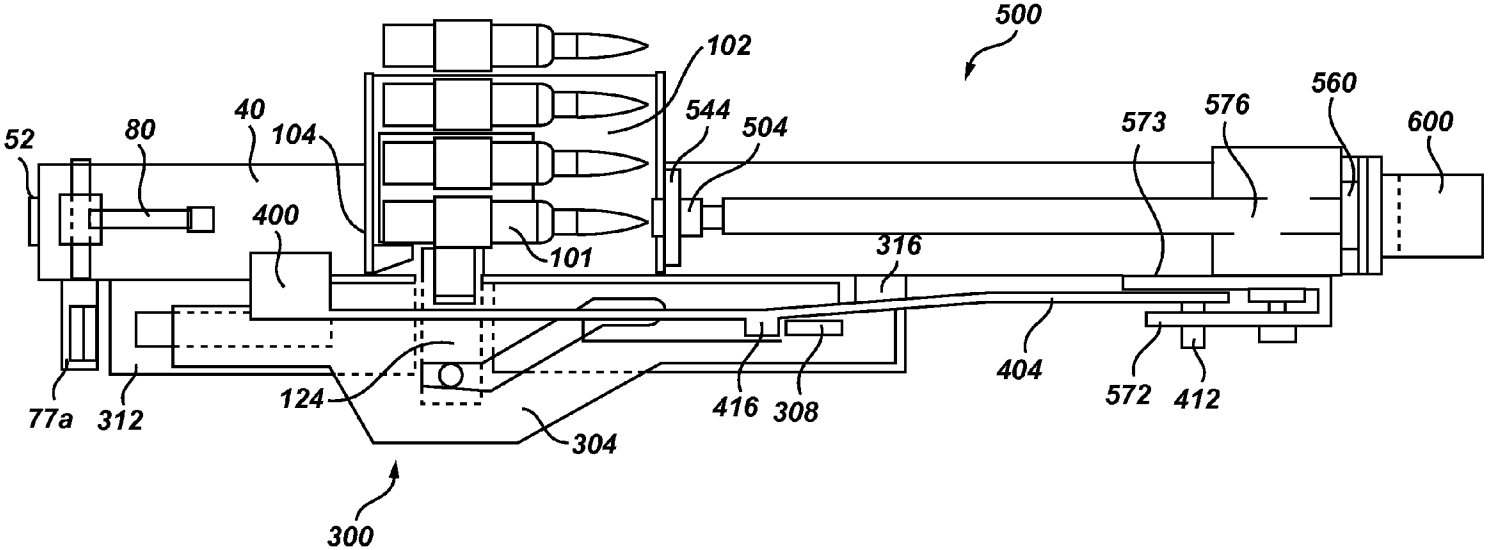
FIG. 2 shows a top view of the ammunition feed adapter.

Turning now to FIG. 1 and FIG. 2, an ammunition feed adapter, generally indicated at 4, may be provided with a main frame 10, a cartridge lift follower body assembly 40, a belt puller assembly 100, a timing plate assembly 300, an operating rod assembly 400, a de-linker assembly 500 (See FIG. 7A), and a forward firearm mount assembly 600. The adapter 4 may be manufactured so that one or more of the non-moving parts of the various assemblies are formed or molded as a single unit. Alternatively, as described herein, the various assemblies can be individually manufactured using standard tools or machines, the individual assemblies may then be fixedly or removably attached to the main frame in order to produce the present invention. The dimensions, tolerances and hardness of the materials used to construct the ammunition feed adapter described herein may vary due to the caliber and type of firearm.

The ammunition feed adapter 4 is attached to the host firearm using the magazine well. The cartridge lift 40 fits into the magazine well as would a normal magazine used by the host firearm, with the magazine catch 52 securing the adapter into position.

The operating rod assembly 400 attaches to the firearm's action mechanism, such as a bolt lever, which provides the mechanical energy needed for the operation of the ammunition feed adapter 4. As the bolt is moved rearward, either manually or by discharge of ammunition in the firearm's chamber, the operating rod 404 pulls the de-linker rod 504, rearward, towards the belt puller assembly 100, where the rod 504 engages a cartridge 101. The cartridge 101 is disengaged from the belt link and forced into the cartridge lift assembly 40 for introduction into the host firearm's firing mechanism. At the same time, the operating arm 404 acts on the timing plate 304 also moving it rearward. As a consequence of the rearward movement of the timing plate 304, the belt puller arm 124 is pulled outwardly towards the timing plate assembly 300 which in turn moves the next cartridge into a loading position, i.e. resting against the cartridge stop 104. Also, as the timing plate 304 is moved rearward, it acts on the cartridge lift outer arm 72 ultimately resulting in the cartridge 101 being inserted into the gun's chamber.

Figure 3A:
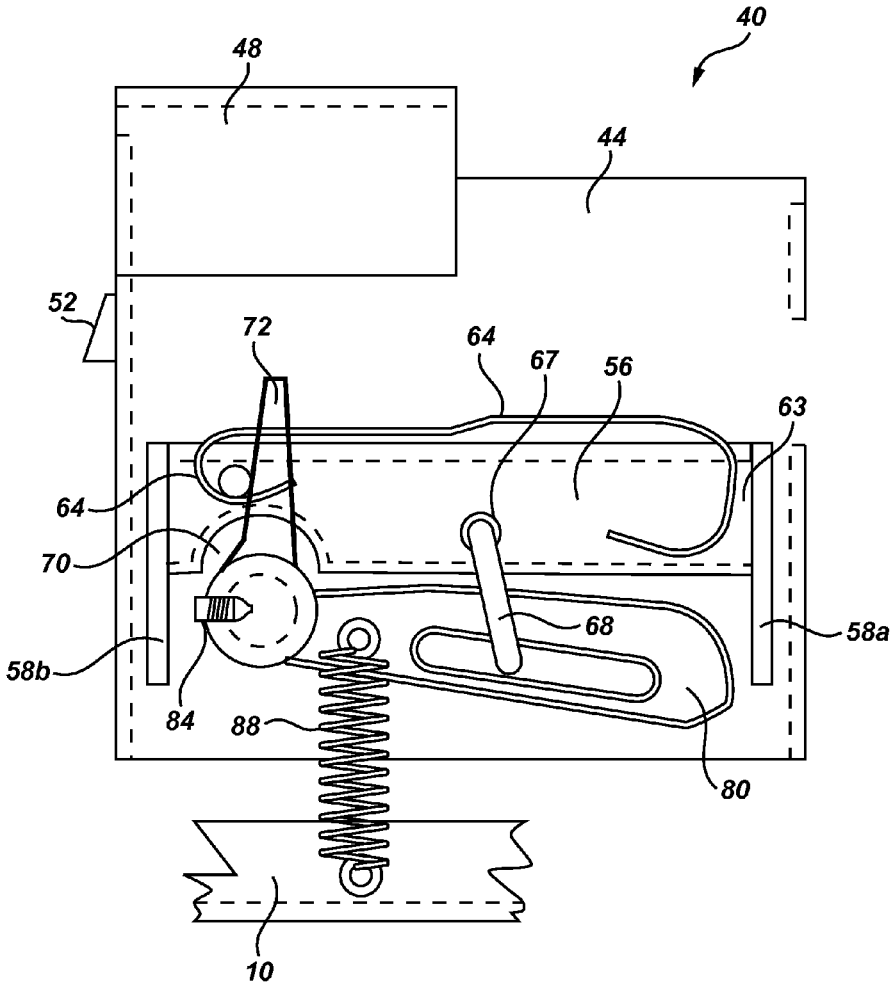
FIG. 3A shows a side, cutaway view of the cartridge lift follower body.
Figure 3B:
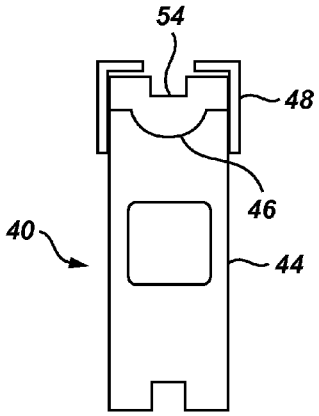
FIG. 3B shows a front view of one embodiment of the cartridge lift follower body.

Now turning to FIG. 3A and FIG. 3B, the cartridge lift 40 includes a cartridge lift follower body 44 which is a rectangular box with a generally open top. Cartridge retainer lips 48 are attached to the top of the lift body 44 to help guide a cartridge into the firearm's chamber. The cartridge lift follower body 44 is shown with an arcuate slot 46 in the front of the lift body which allows a cartridge to pass during chambering. In addition, a channel 54 in the rear allows for bolt clearance during operation of a firearm. Finally, a magazine catch 52 is provided to allow the magazine latch of the host firearm to securely connect the ammunition feed adapter thereto.

Figure 3C:
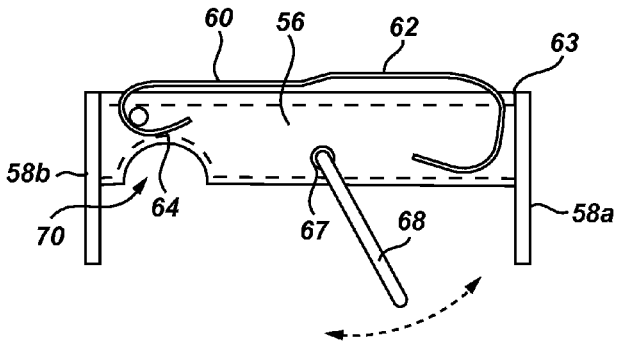
FIG. 3C shows a side view of the cartridge lift follower and associated parts according to one embodiment of the present invention.

The cartridge lift follower 56, embodied in FIG. 3C, can be made out of square steel tubing with end caps 58*a*, 58*b* extending beneath the follower 56. The cartridge lift follower 56 has a longitudinal slot for receiving the cartridge support spring 60. The cartridge support spring 60 is a length of flat spring designed to dampen the impact of a cartridge against the cartridge retainer lips 48 (See FIG. 3B) when it is lifted into place by the cartridge lift follower 56 prior to chambering. The support spring 60 is held in place by using a retainer pin 64 that extends through the cartridge lift follower body at one end thereof. The end 62 of the support spring 60 is bent so that the front of a cartridge remains elevated as it leaves the retainer lips 48 in order to facilitate chambering of the cartridge. A space 63, between the end cap 58*a* and the bent end 62 of the support spring 60, allows the spring to extend when compressed.

To further lessen the impact of a cartridge against the retainer lips 48, a capture link 68 is provided. Capture link 68 is attached to and suspended beneath the cartridge lift follower 56. The capture link 68 can be made of steel rod bent to form an open-ended link that attaches to the lift body 56 via a hole 67 that is drilled laterally in the lower center portion thereof. The cartridge lift follower return spring 88 (See FIG. 3A) is connected to the follower arm 80, holding the cartridge lift follower 56 at the bottom of the cartridge lift assembly 40. The lift follower return spring 88 provides a downward force on the lift follower 56 when it is attached thereto via the capture link 68. This force dampens the impact of a cartridge against the retainer lips 48 and also is responsible for the return of the lift follower 56 to the bottom of the cartridge lift assembly 40 at the end of each cycle.

Figure 3D:
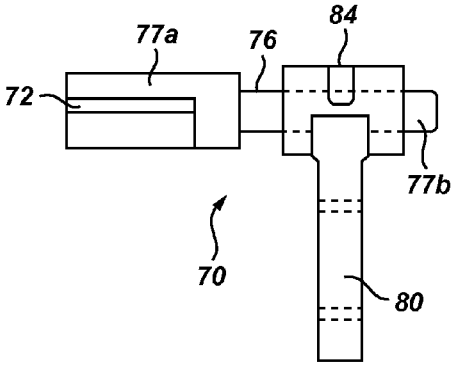
FIG. 3D shows a top view of the cartridge lift arm assembly according to one embodiment of the present invention.
Figure 3E:
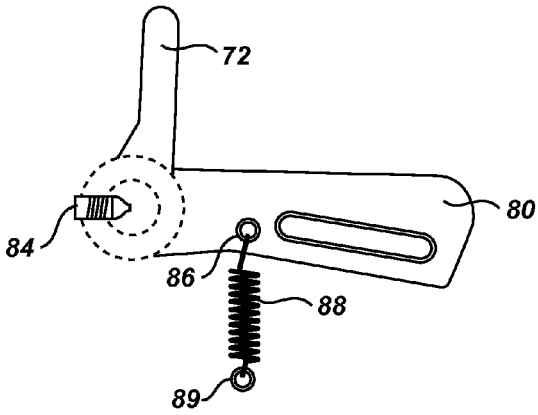
FIG. 3E shows a side view of the cartridge lift arm assembly.

Now referencing FIG. 3D and FIG. 3E, a top view of one embodiment of the cartridge lift arm 70 is provided. The cartridge lift arm 70 further comprises an axel 76 that connects an outer arm 72 to an inner arm 80. The outer arm 72 is contacted by the timing plate arm 308, forcing it backwards (discussed in more detail below). The backwards force is transferred along the axel to the inner arm which pushes the cartridge lift follower 56 in an upward direction.

The axel 76 has an end 77*a* to which the outer arm 72 is attached thereto. The axel 76 also has a second end 77*b* having a smaller diameter, as compared to 77*a*, to which the inner arm 80 is attached. One way the inner arm may be attached to end 77*b* is by boring out a piece of rod so that it slips over the end 77*b*, set screw 84 is then used to secure inner arm 80 in the desired position. A coil spring 88 provides the energy required for the return of the inner arm to the bottom of the cartridge lift follower body 44. The coil spring 88 is mounted to the main frame 10 (See FIG. 1) at one end 89 and to the inner arm 80 at the other end 86.

Figure 4A:
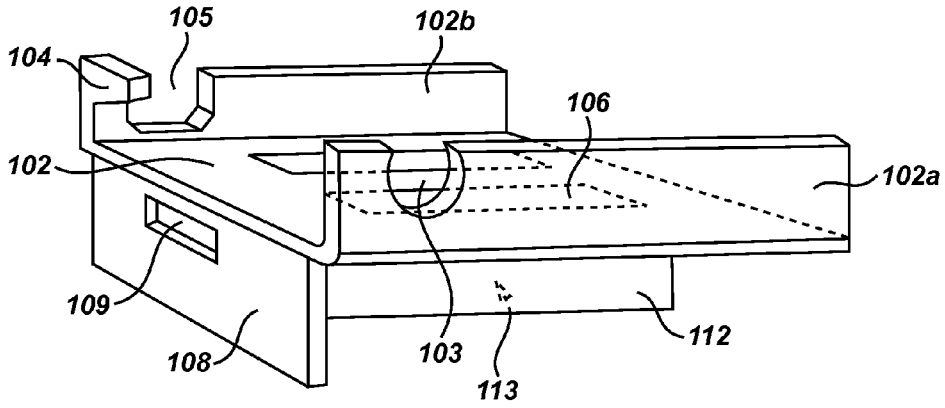
FIG. 4A shows a perspective view of one embodiment of the belt puller tray.

Now turning to the belt puller assembly 100. FIG. 4A shows one embodiment with belt tray 102 and sides 102*a*, 102*b*. The sides 102*a* and 102*b* act as cartridge guides during operation of a host firearm. Side 102*a* has an arcuate slot 103 cut therein to allow the de-linker assembly 500 to act upon the linked cartridges. Similarly, side 102*b* has an opening 105 cut therein to allow exit of the de-linked cartridge from the belt puller assembly 100 into the cartridge lift follower body 44. A cartridge stop 104 is also provided in order to hold the rear of a cartridge in alignment. Finally, the belt tray has at least one slot 106 formed on the floor of the tray which provides access and guidance for the belt puller teeth 144 (See FIG. 4C).

Also shown is the mounting plate 108 which can be formed as part of the belt tray 102 or can otherwise be fixedly attached. The mounting plate 108 has a slot 109 located on the face thereof to allow the belt puller arm 124 to pass therethrough. The mounting plate 108 is used to attach the belt puller assembly 100 to the main frame 10 (FIG. 1). Adjacent the mounting plate 108 is the belt puller guide 112. The belt puller guide 112 can be made from a piece of flat metal bent at two ninety degree angles. The resulting three sides of the belt puller guide 112 and the back side of the mounting plate 108 define a compartment 113 containing the belt puller teeth guide spring arms 116 and a section of the belt puller arm 124 as described in further detail below (See FIG. 4C).

Figure 4B:
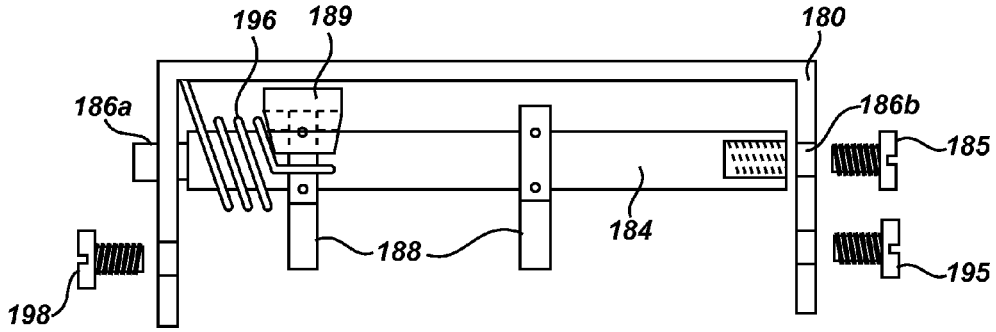
FIG. 4B shows a side view of one embodiment of the belt lock assembly.

Before describing the action of the belt puller assembly 100 in further detail, FIG. 4B provides one embodiment of the belt lock 176 which attaches to the belt puller tray. As shown, one way the belt lock 176 may be affixed to the tray is by using screws 198. The side member of the belt lock frame 180 are descended along the outer surface of sides 102*a* and 102*b* (FIG. 4A), the screws are tightened, and finally the screws 198 are filed flush with the inner surfaces of sides 102*a* and 102*b*. The belt lock retainer rod 184 is mounted to the frame 180. The retainer rod 184 can be made from a length of steel rod that has been turned on a lathe at one end to fit into the mounting hole 186*a* and drilled and threaded on the other end in order to be able to receive a mounting screw 185 inserted through mounting hole 186*b*.

In addition, attached to the belt lock retainer rod 184 is at least one retainer 188 or, more preferably, a set of retainers 188. The retainers 188 are spaced along the rod at a width that keeps them from contacting the links of the ammunition belt and are also shaped to fit the intended cartridge with respect to said cartridge's diameter. At least one of the retainers 188 has a belt lock tab 189 which allows the retainers to be manually lifted in order to remove the ammunition belt from the belt puller assembly 100. A spring 196 wraps around the rod 184 and hooks to a retainer at one end and extends to the roof of the frame 180 at the other end thereby providing a constant downward force on the retainers 188.

Figure 4C:
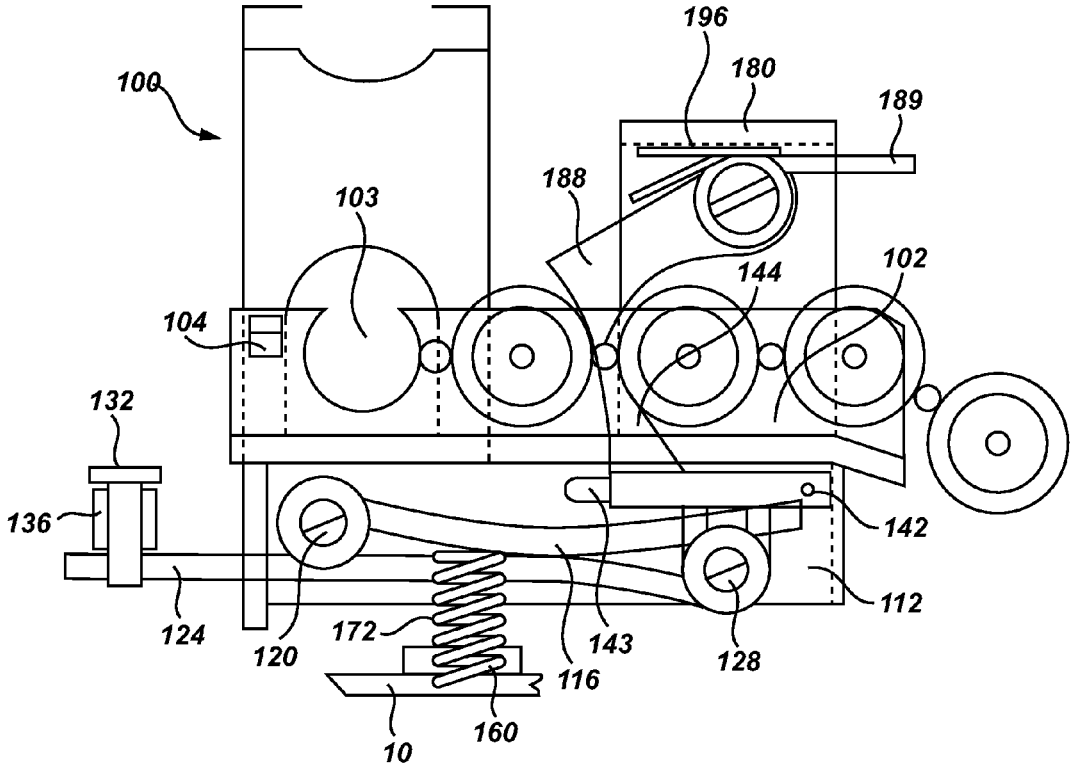
FIG. 4C shows a side, cutaway view of the belt puller assembly in the set position.
Figure 4E:
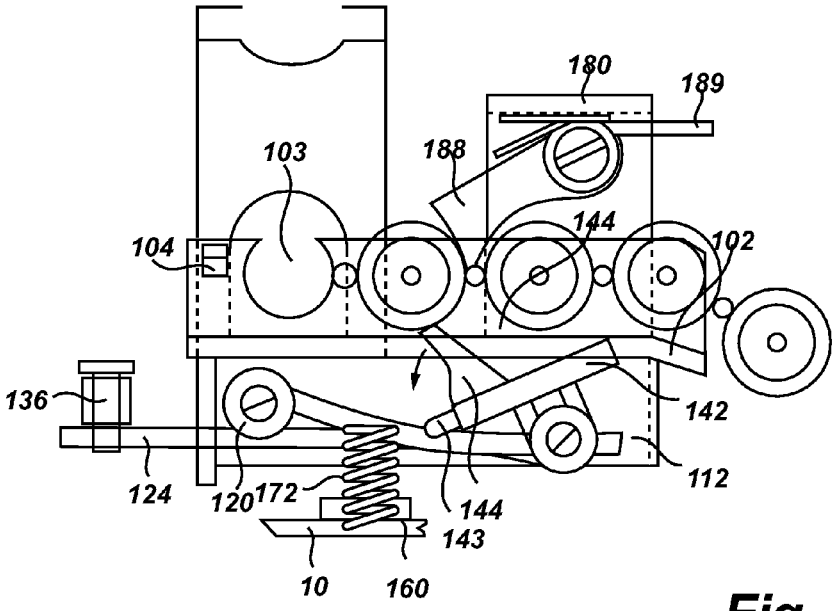
FIG. 4E shows a side view of the belt puller assembly as it moves beneath the cartridge when returning to the set position.
Figure 4D:
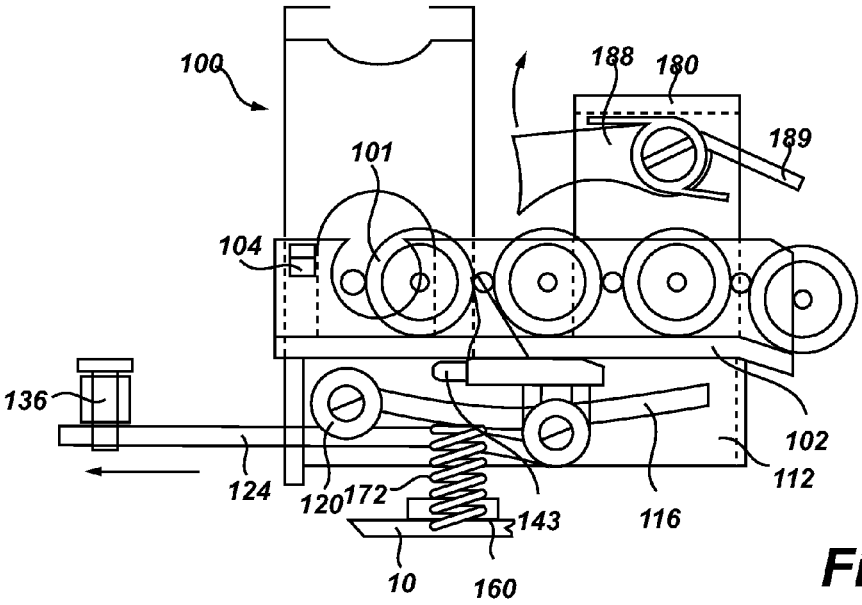
FIG. 4D shows a side, cutaway view of the belt puller assembly moving a cartridge to the load position.

FIGS. 4C through 4E show more detailed cutaway, side views of the belt puller assembly 100. Linked cartridges of an ammunition belt are loaded into the belt tray 102 by inserting the first cartridge 101 into belt lock 176 until it passes the retainers 188. Pushing the ammunition belt into the belt lock 176 provides enough force to the generally curved back of the belt puller teeth 144 to force them downward. Once the cartridge 101 has cleared the tip of the teeth 144, the teeth return to the "set position" as seen in FIG. 4C. (The set position correlates with the host firearm's bolt being open.) The teeth 144 return to the set position because an upward force is applied to the base 142 of the teeth 144, which is supplied by the spring 172 and the spring guide arms 116. The spring 172 and guide arms 116 are secured to the belt puller guide 112 using pins and base plate 160. In the set position, the retainers 188 and teeth 144 are positioned so that the cartridge 101 is locked into the belt puller assembly 100. However, the ammunition belt can be removed by pressing down on the lock tab 189 and pulling the belt free from the belt puller assembly 100.

As seen in FIG. 4D, when the host firearm's bolt is closed, the belt puller arm 124 moves in an outward direction 125 via the timing plate assembly 300 (See FIGS. 5A and 5B) and operating rod assembly 400 (See FIG. 6), which are described in further detail below. The outward force pulls the cartridge 101 into the "load position" against the cartridge stop 104. FIG. 5B shows a cartridge 101 as it is being moved to the load position. As this is happening, the retainers 188 will be lifted, against the downward force of the belt lock spring 196 (FIG. 4B), by the second cartridge until the second cartridge passes. Once the second cartridge has cleared, the retainers 188 will return to the set position holding the ammunition belt in place. The first cartridge 101, in the load position, is ready to be de-linked and enter the cartridge lift follower body 40. FIG. 4E shows the belt puller arm 124 moving inward after the host weapon fires a bullet, with the teeth 144 dipping under the next cartridge on the cartridge belt. Contact between the generally curved back of teeth 144 and the next cartridge forces the guide arms 116 downward, compressing the spring 172, and allowing the teeth 144 to pass underneath the cartridge.

Firing of the host firearm results in a large amount of torque which is transferred to the puller arm 124. To counter this force, a preferred embodiment of the invention will have a kickback stop 143 and an extended teeth base 142 which increase the friction through contacts made with the belt tray 102 and guide arms 116 in order to counter the force generated by the gun's recoil.

Figure 4F:
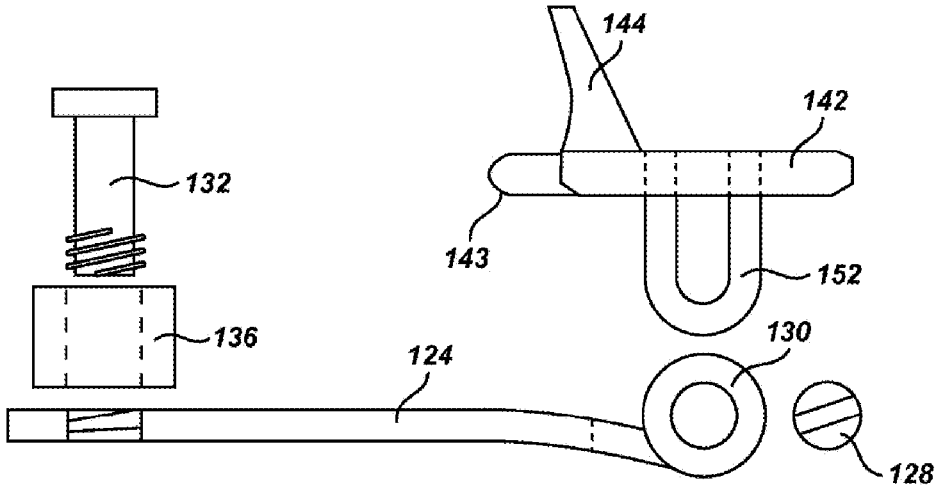
FIGS. 4F(a) through 4F(c) shows a side exploded, end, and side assembled views of one embodiment of the puller arm.
Figure 4F:
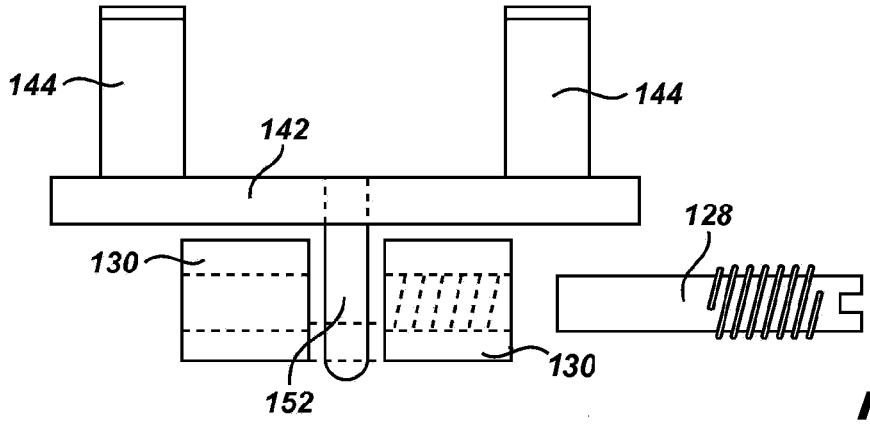
Figure 4F:
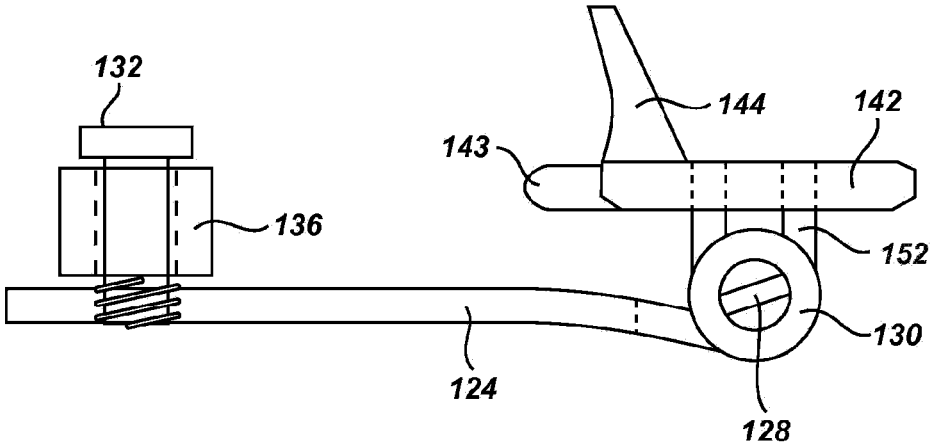
Figure 4F:
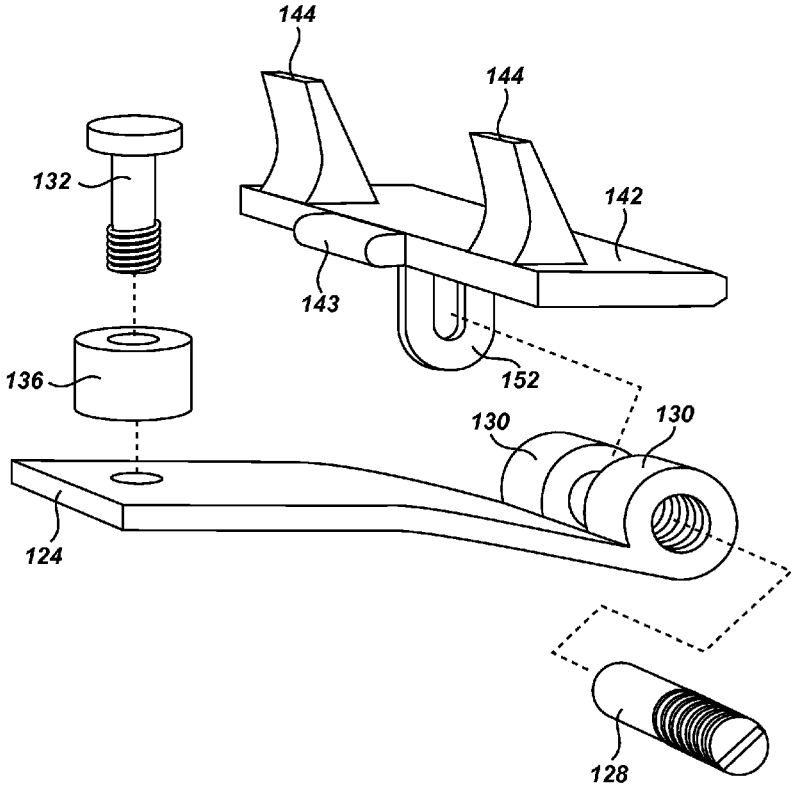
Figure 4G:
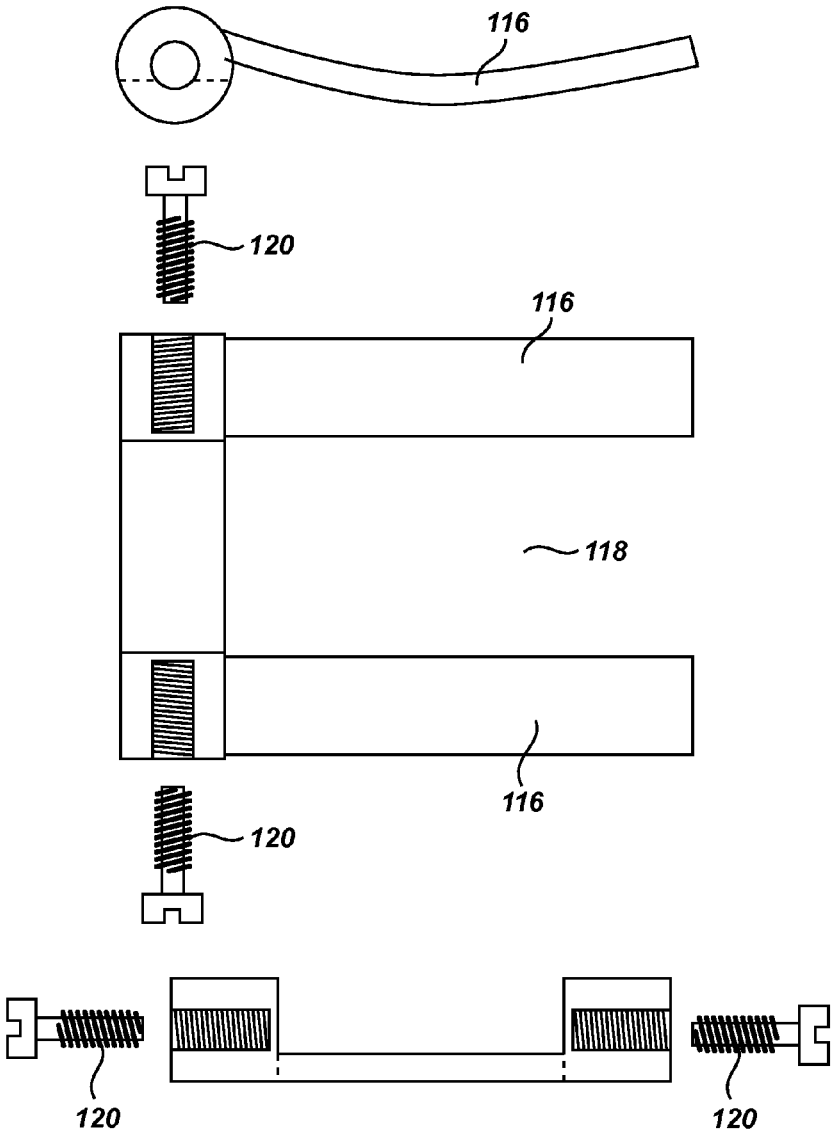
FIG. 4G shows one embodiment of the spring guide arms.

The belt puller arm 124 can be made out of flat steel bar, or other suitable material, with at least one tooth 144 attached at one end. At the other end is attached a bearing that extends orthogonally from the puller arm 124 and engages the timing plate 304 (FIG. 1B). The guide arms 116 can be made out of similar material as the belt puller arm. FIGS. 4F(a), FIG. 4F(b), 4F(c) and 4F(d) show side-exploded, end, side-assembled and perspective views of one embodiment of the puller arm 124 and FIG. 4G shows one embodiment of the guide arms 116 of the present invention. As seen in FIGS. 4F(a) through 4F(d), said orthogonally extended bearing is comprised of a bearing ring 136 and roller bolt 132. Also, in a preferred embodiment, the puller arm 124 includes at least two puller teeth 144 that are attached in a hinge-like fashion. Where the teeth 144 are attached, the puller arm 124 is formed into a threaded hinge 130 to receive a headless screw 128. Extending downward from the base of the teeth 144 is a connector link 152 where the screw 128 passes through to connect the teeth 144 and the arm 124. As seen in FIG. 4G, the spring guide arms 116 have a slot 118 therein to accommodate the puller arm 124 when assembled. In other embodiments, the belt puller assembly 100 may include a rotating gear that would function in a manner similar to the assembly with puller arm 124 described above except that a gear having teeth to advance the belt would rotate to advance each round.

Figure 5A:
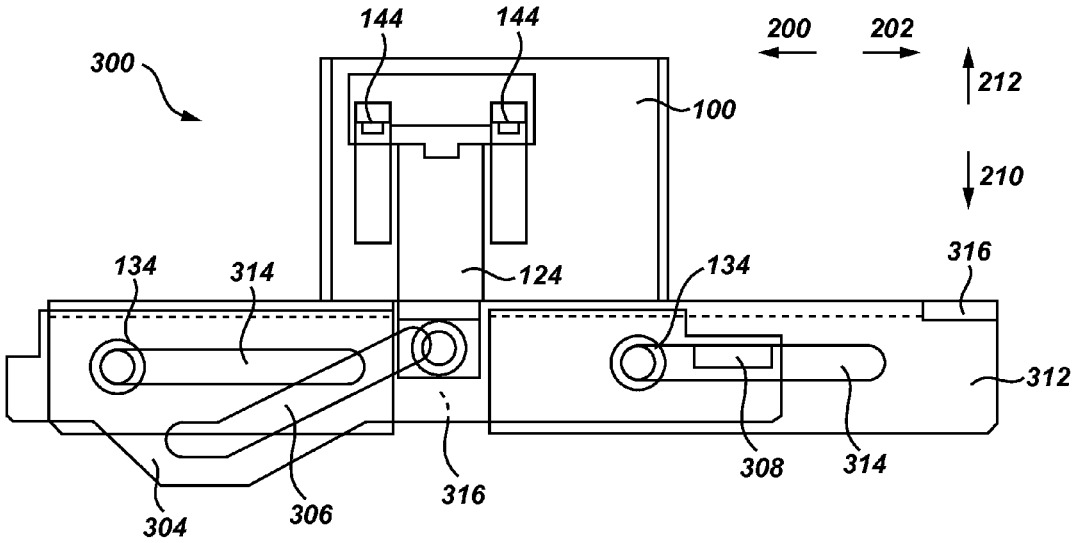
FIG. 5A shows the timing plate in its full back position.
Figure 5B:
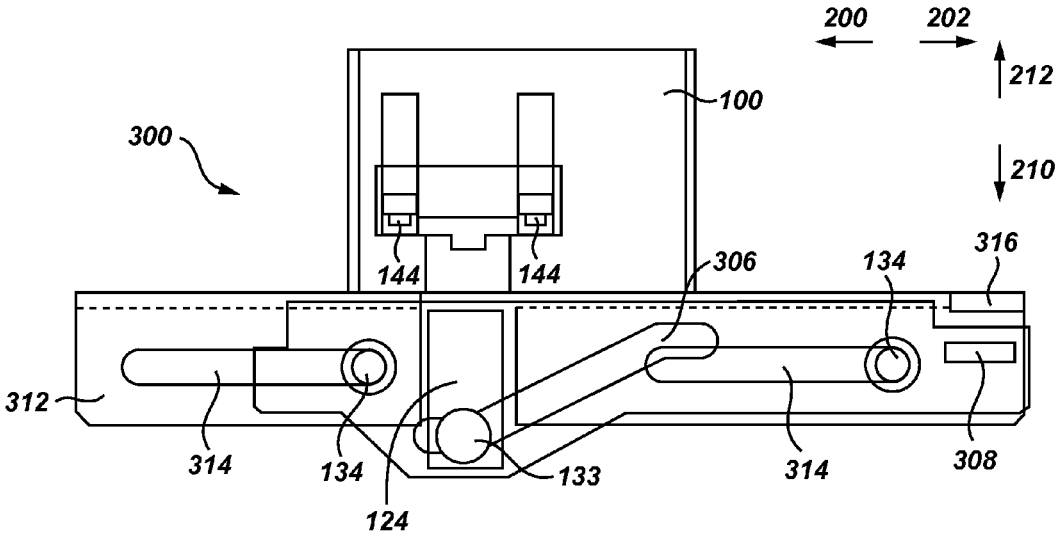
FIG. 5B shows the timing plate in its full forward position.

Referring now to FIG. 5A and 5B, the timing plate assembly 300, in connection with the operating rod assembly 400 (FIG. 6), couples the movement of the belt puller tray assembly 100 with the firing of the host firearm. The timing plate assembly 300 includes two basic parts, the timing plate guide 312 and the timing plate 304. The timing plate guide 312 is mounted to the main frame 10, or alternatively, formed as part of the frame itself. The plate 304 is positioned above the guide 312 and connected thereto using bearings 134 mounted on plate 304 (such as roller bolts 132 and roller bearing rings 136 described above) and which extend through the bi-lateral slots 314 in the guide 312. The diagonal slot 306 connects the plate 304 to the belt puller arm 124 by extending the bearing 133, which is attached to the arm 124, through said diagonal slot. The timing plate assembly 300 further comprises a space 316 in the guide 312 wherein the belt puller arm 124 is positioned in order to guide its movements, a timing plate arm 308 that is formed or attached to the timing plate 304, and a timing plate cam 316 that is formed or attached to the guide mount 312.

The timing plate 304 is propelled in the direction indicated by arrow 200 when the timing plate arm 308 receives catch pin 412, of the operating rod assembly 400, as the host firearm is manually charged or a cartridge is discharged. Moving the timing plate in a backwards direction forces the belt puller arm in the direction indicated by arrow 212 by virtue of said arms being connected to the diagonal slot 306 and its travel therein. The plate's 304 movement is guided by the slots 314 in the timing plate guide mount 312. When the plate is in the position seen in FIG. 5A the belt puller teeth 144 are in the set position and the host firearm's bolt is open. Closing of the host firearm's action will lead to the timing plate 304 being moved in a forward direction indicated by arrow 202 until it reaches the full front position and resulting in the belt puller teeth 144 moving the next cartridge into the load position. The cycle is then repeated.

Figure 6A:
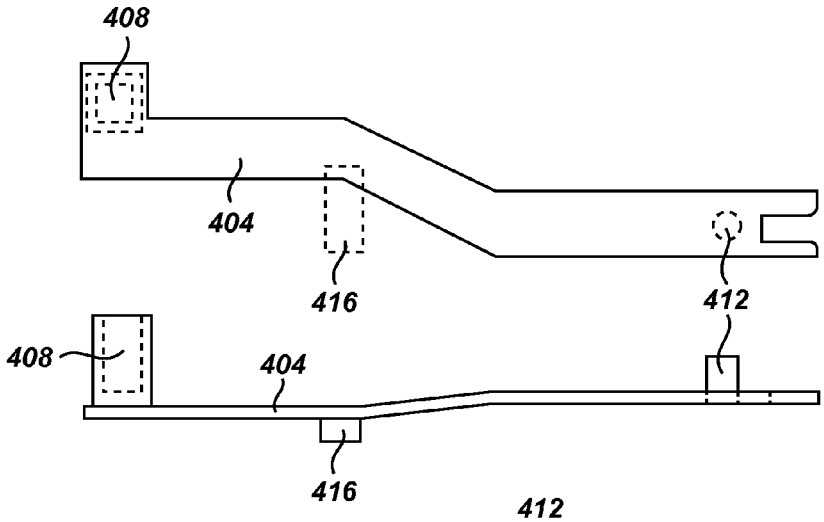
FIGS. 6A through 6C show a side, top and bottom views respectively of the operating arm assembly and its engagement with the de-linker latch according to one embodiment of the present invention.
Figure 6B:
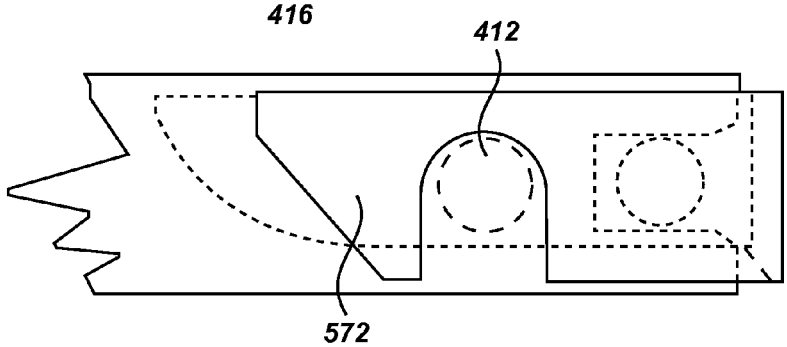
Figure 6C:
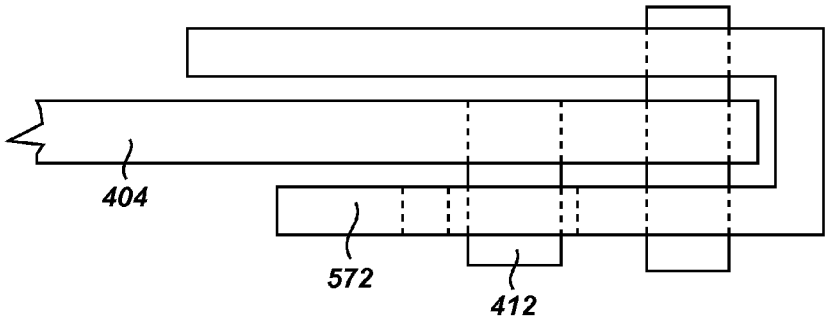

Now turning to FIG. 6, a side and top view of one embodiment of the operating rod assembly 400 is provided which shows the operating rod arm 404 with a mounting attachment 408, catch pin 412 and catch arm 416 attached thereto. The operating rod arm 404 is connected to the host firearm's action mechanism, such as a bolt, using the mounting attachment 408. The mounting attachment 408 can be made to accommodate a variety of firearms. One embodiment uses a set screw as a means of attaching to the cocking lever of a firearm. Another embodiment has a mount that fits over the cocking lever, with a slide lock that is rotated downward, keeping the operating rod arm 404 in alignment.

The operating rod assembly 400 coordinates the operation of the ammunition feed adaptor as follows. The catch arm 416 contacts the back of the timing plate arm 308 (FIG. 5A) when the host firearm's bolt closes in order to drive the timing plate 304 forward. The catch pin 412 contacts the front of the timing plate arm 308 after the host firearm is fired, driving the timing plate 304 backwards. Also, the catch pin 412 is received by the de-linker latch 572, and coordinates the action of the de-linker assembly 500 as described below. The spacing of these contact points is key to the operation of the ammunition feed adapter with a given weapon. The difference in spacing between the contact points on a particular ammunition feed adapter allows for precisely timed and coordinated function with a variety of host weapons.

Figure 7A:
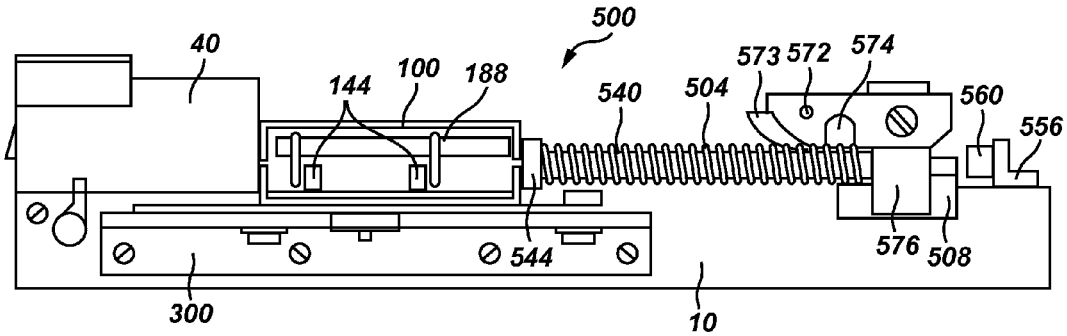
FIG. 7A shows a side view of the ammunition feed adapter with a more detailed cutaway view of the de-linker assembly according to one embodiment of the present invention.
Figure 7B:
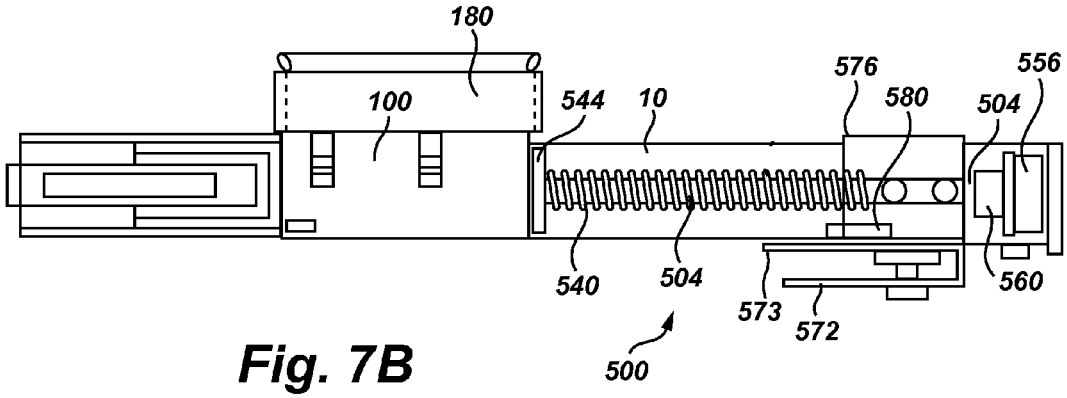
FIG. 7B shows a top, cutaway view of the de-linker assembly.

Turning now to FIG. 7A and FIG. 7B, a cutaway side and top view, respectively, of one embodiment of the de-linker assembly 500 is shown mounted on main frame 10. The de-linker rod 504 extends from the base 508 towards and through the de-linker rod guide 544. The guide 544 aligns the end of the rod 504 for entry into the belt puller assembly 100 when the de-linker return spring 540 is in the fully relaxed position. When in the fully relaxed position the base 508 rest against the de-linker return stop 560.

At the other end, the de-linker rod 504 is attached to the base 508. In one embodiment of the present invention the main frame 10 is made out of square steel tubing and the base 508 is shaped and sized such that it is able to slide freely within the frame 10 without becoming bound. The base 508 has a ridge extending upward that fits into a longitudinal slot cut into the top of the main frame 10 in order to keep the de-linker rod 504 aligned with respect to the frame 10 while in operation.

Attached to the ridge extending through the main frame 10 is a latch frame 576. The latch frame 576 extends over the external surface of the main frame 10 and provides an attachment point for the de-linker latch arms 572, 573. The dual arms 572,573 can be formed from one piece of material and are attached with a means which allows them to freely rotate up and down. However, the default position is parallel with the main frame 10 which is maintained by applying a downward force using a spring 580 that is attached to the latch frame 576 at one and the latch arms 572, 573 at the other. Both latch arms 572 and 573 are made to have a generally curved shape, with arm 573 having a slightly greater length than arm 572. Finally, arm 572 has a latch 574 that is designed to receive the catch pin 412 of the operating rod arm 404.

Figure 7C:
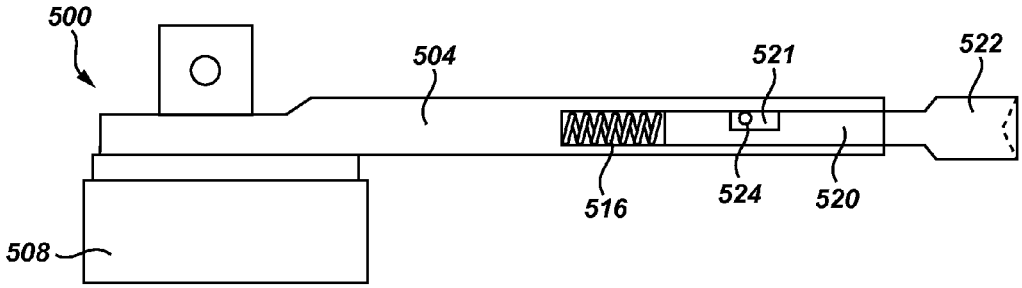
FIG. 7C shows a side, cutaway view of the de-linker rod and associated components according to one embodiment of the present invention.

As seen in FIG. 7C, one embodiment of the de-linker rod 504 is bored on one end to accept the cartridge buffer 520 and buffer spring 516. The cartridge buffer has a flat cut 521 made thereon to accommodate a pin 524 which is inserted through a hole drilled in the de-linker rod 504. Additionally, the cartridge buffer head 522 is counter bored to form a guide which, upon impact, aligns the cartridge for entry into the lift body assembly 40.

Figure 7D:
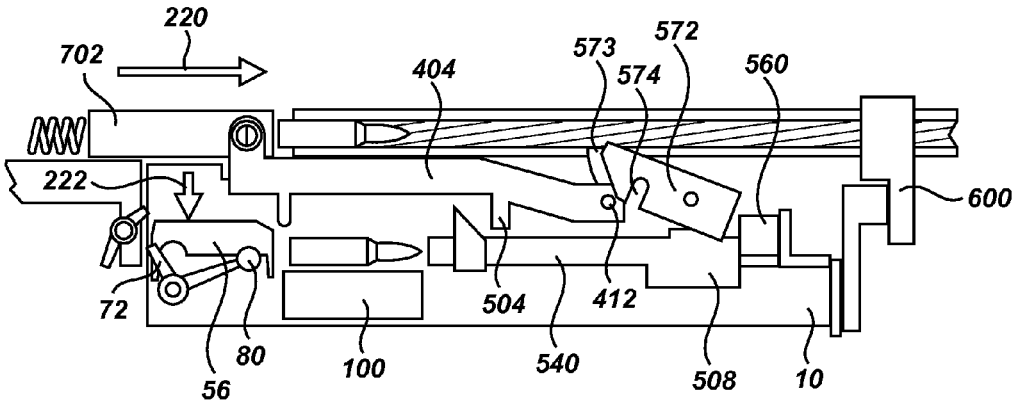
FIG. 7D shows a side, cutaway view of the de-linker assembly receiving the operating rod arm assembly.
Figure 7E:
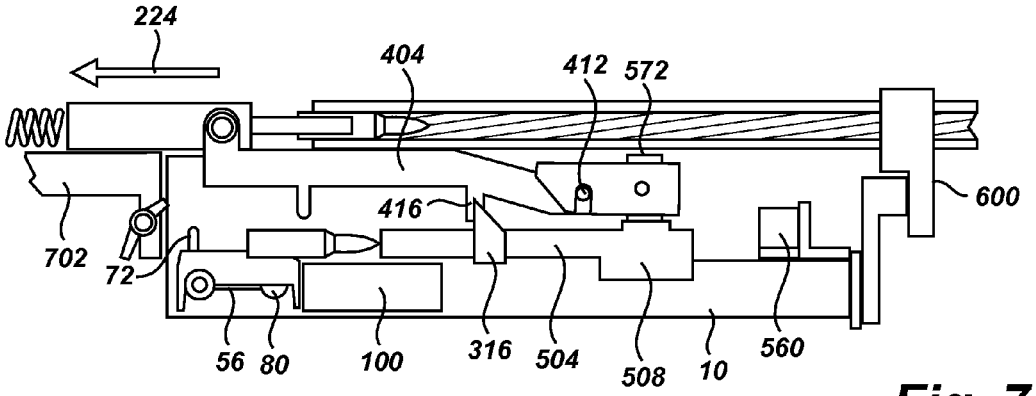
FIG. 7E shows another side, cutaway view of the de-linker assembly as it is being pulled rearward by the operating rod arm assembly.
Figure 7F:
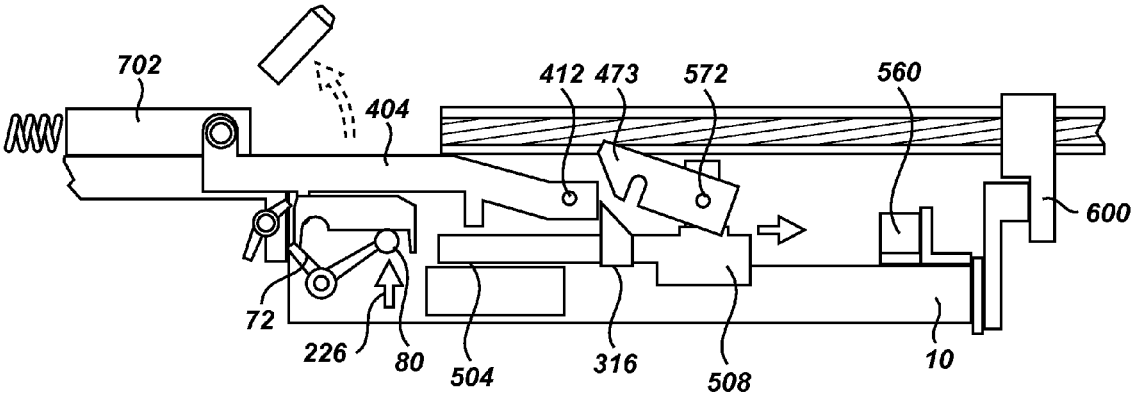
FIG. 7F shows yet another side, cutaway view of the de-linker assembly, as it is being released from the operating rod arm assembly.

Now turning to FIG. 7D-7F, the operation of the de-linker assembly 500 is coordinated by the function of the operating rod arm 404. The operating rod arm 404 is attached to the host firearm's action 702 which provides the mechanical force for the entire operation of the ammunition feed adapter. When the action is moved in the direction indicated by arrow 220, the catch pin 412 impacts the curved surface of latch arm 572 and forces the arms 572, 573 upward until the pin 412 is received in slot 574, connecting the de-linker assembly with the operating rod assembly.

The energy generated from the discharge of a cartridge causes the firearm's action 702 to open. This energy is transferred to the de-linker system through the operating arm 404, forcing the de-linker rod 504 rearward until it engages the next cartridge, driving the cartridge into the cartridge lift follower body. Finally, when the latch arm 573 contacts the timing cam 316 on the timing plate guide mount, the arms 572, 573 are again forced upward, the catch pin 412 is released, the de-linker return spring 540 is allowed to decompress, which forces the base to return to rest against the de-linker return stop 560. The cycle is then repeated.

Figure 8:
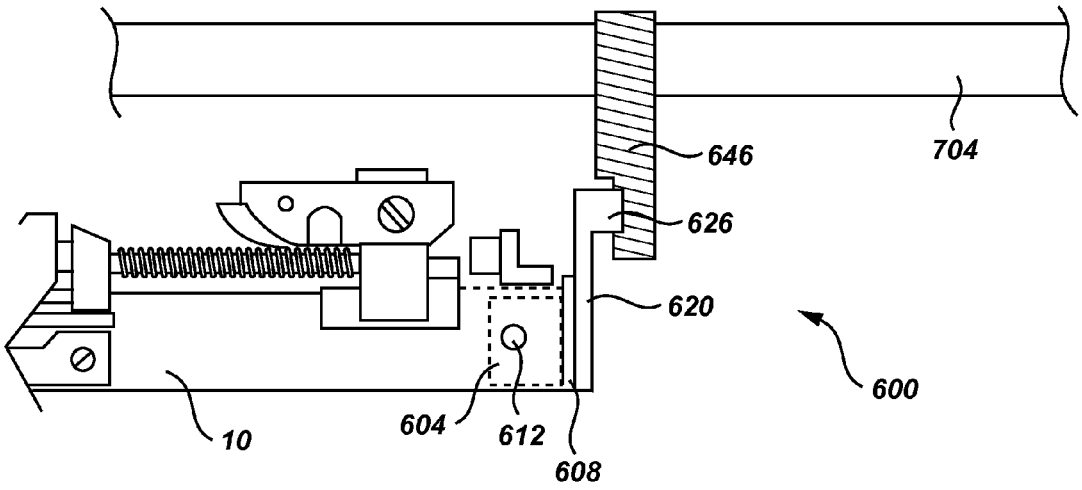
FIG. 8 shows a side view of the ammunition feed adapter and one embodiment of the forward firearms mount assembly according to the present invention.

Now referring to FIG. 8, a side view of one embodiment of the forward firearm mount assembly 600 is provided. To increase the stability of the ammunition feed adapter when mounted to a firearm, an optional forward firearm mount assembly 600 may be used. The firearm mount adapter 600 has an internal section 604 that extends into the main frame 10 of the ammunition feed adapter and is held in place by inserting a quick disconnect pin 612 through aligned holes in the frame 10 and internal section 604. An end cap 608, which sits against the outer edge of the frame 10, aids in aligning the two holes. Also, the end cap is configured to receive a number of mounts 620 which are designed for specific use with various firearms. The head 624 of a generic mount 620 sits within a recessed portion of the firearm mount adapter base 646 which is affixed to the host firearm at a given location, for example the barrel. This allows the adapter to be released and mounted into the magazine of the firearm in a few seconds. Once mounted in the magazine, the adapter allows the firearm to be belt-fed rather than relying on magazines.

Figure 9:
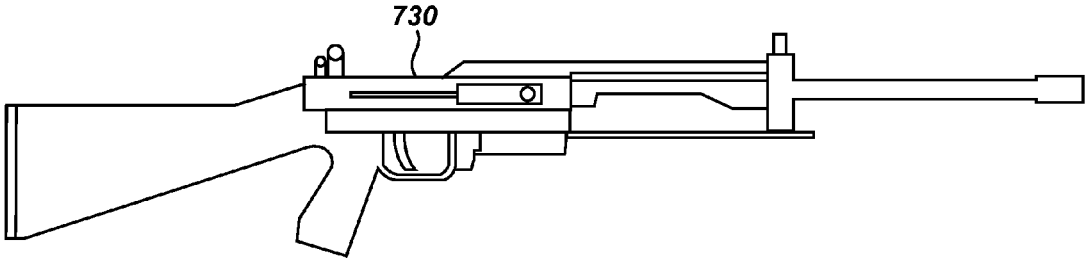
FIG. 9 shows an ammunition feed adapter configured for use on a number of firearms as the barrels of the firearms become overheated.
Figure 9:
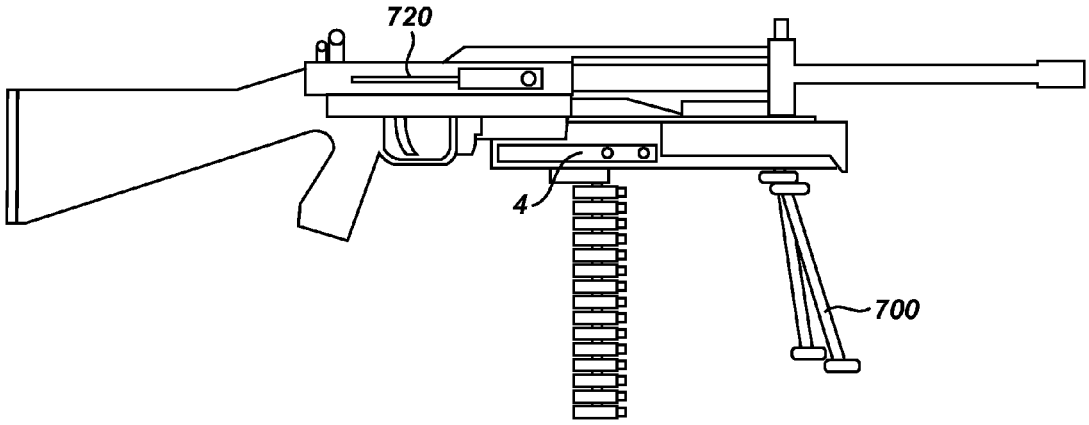

Turning now to FIG. 9, an ammunition feed adapter is shown configured for use on a number of firearms. The adapter 4 may include a collapsible tripod 700 if desired, to allow the host firearm to be used in a manner similar to a SAW.

One concern with automatic firearms is the considerable heat which can be generated. Firing hundreds of rounds through a barrel in a very short period of time can cause the barrel to overheat. The heat of the barrel can also cause the ammunition rounds to fire prematurely, often called "cooking off." Because many lighter firearms were not designed to handle sustained firing for prolonged periods of time, leaving a firearm in full automatic fire mode can overheat the barrel in as little as a minute. One advantage of the present invention is that the adapter 4 can be quickly changed out of one firearm and into another.

Thus, FIG. 9 shows the adapter 4 mounted in a generic magazine-fed weapon. A typical assault rifle can fire up to 600 rounds per minute. However, such a volume will cause the barrel to quickly heat up. Rather than waiting for the barrel to cool back down before firing, the rifle 720 is simply removed from the adapter 4 and a new rifle 730 is attached in its place. The second rifle 730 can be used for firing while the first rifle cools down. Multiple rifles can be used with the adapter 4 to maintain automatic fire for prolonged periods of time. The entire process of changing the rifles 720, 730, etc., takes only moments longer than changing a magazine in the rifles individually. One soldier can be changing rifles while another is attaching belts together to provide a continual supply of ammunition.

Additionally, unlike a SAW, if the soldiers are forced to evacuate their position, each can take one of the rifles and those which are not being used with the adapter 4 can be readied for use by simply inserting a magazine.

One major advantage of the present invention is that it will allow a squad of soldiers to have multiple rifles which are capable of use as belt-fed automatic firearms. This dramatically lessens the abilities of enemies to cripple the squad by initially targeting the SAW. It also allows smaller, lighter firearms to be used for automatic fire from a number of locations—allowing the defensive perimeter to change much more rapidly.

There is thus disclosed an ammunition feed adapter that can convert a magazine-fed gun into a belt-fed gun. It will be appreciated that numerous changes may be made to the present invention without departing from the scope of the claims.

What is claimed is:

1. An ammunition feed adapter for attachment to a gun comprising:

a body releasably attachable to a gun such that when the body is removed from the gun the gun functions as originally intended;

a cartridge lift assembly coupled to the body and shaped to nest in a magazine well of the gun;

a belt puller assembly for providing ammunition to the cartridge lift assembly, wherein the belt puller assembly is coupled to the body; and an operating rod assembly disposed in communication with the belt puller assembly and directly attachable to the action mechanism of the gun such that movement of the action mechanism causes engagement of a cartridge that forces the cartridge into the lift assembly.

2. The ammunition feed adapter of claim 1, further comprising a timing plate assembly having a timing plate and a timing plate guide coupled to the body of the ammunition feed adapter, wherein the timing plate and the timing plate guide are oriented substantially parallel to each other.

3. The ammunition feed adapter of claim 1, further comprising a de-linker assembly for removing ammunition from an ammunition belt.

4. The ammunition feed adapter of claim 1, wherein the belt puller assembly further comprises a belt puller tray for receiving a belt of linked ammunition, the belt puller tray having a first side and a second side and a floor having at least one slot therethrough.

5. The ammunition feed adapter of claim 1, wherein the operating rod assembly is configured for removable attachment to the action mechanism of the gun.

6. The ammunition feed adapter of claim 2, wherein the operating rod assembly contacts the timing plate and moves the timing plate linearly along a horizontal plane relative to the gun.

7. The ammunition feed adapter of claim 1, further comprising a forward firearm mount assembly for attaching the adaptor to the gun body.

8. The ammunition feed adapter of claim 1, further comprising a belt having a plurality of rounds of ammunition attached to the adapter.

9. A method for converting a magazine-fed firearm into an ammunition belt-fed firearm, the method comprising:

selecting a functional magazine-fed firearm comprising a firearm body, a magazine well, and a firing mechanism;

selecting an ammunition feed adapter having a cartridge lift assembly configured for removable attachment in the magazine well, a belt puller assembly, and an operating arm assembly disposed in communication with the belt puller assembly;

mounting the ammunition feed adapter so that the cartridge lift assembly is disposed in the magazine well; and attaching the operating arm assembly directly to the action mechanism of the magazine-fed firearm.

10. The method according to claim 9, further comprising loading an ammunition belt into the belt puller assembly after the ammunition feed adapter is mounted to the magazine-fed firearm.

11. The method according to claim 10, further comprising advancing the ammunition belt such that:

a round of ammunition is de-linked from the ammunition belt with a de-linker assembly of the ammunition feed adaptor;

the ammunition belt is advanced to the next round on the ammunition belt with the belt puller assembly; and the de-linked round is lifted within the magazine well for chambering in the magazine-fed firearm.

12. The method of claim 9, wherein mounting the ammunition feed adaptor to the firearm includes attaching a forward firearm mount assembly to a portion of the firearm ahead of the magazine well.

13. The method of claim 9, wherein the firearm is an automatic rifle.

14. An belt fed weapon comprising:

a gun having a body, a magazine well for receiving ammunition and a firing mechanism; and an ammunition feed adapter releasably attachable to the gun, the ammunition feed adapter comprising:

a body;

a cartridge lift assembly coupled to the body and configured for attachment in a magazine well of the gun;

a belt puller assembly coupled to the body for providing ammunition to the cartridge lift assembly; and a timing plate assembly coupled to the body the timing plate assembly comprising a timing plate and a timing plate guide oriented substantially parallel to the timing plate;

wherein the gun is functional both when the ammunition feed adapter is attached to the gun and when unattached to the gun.

15. The ammunition feed adapter of claim 14, wherein the firing mechanism includes a bolt and wherein the ammunition feed adapter includes an operating arm for engaging the bolt such that movement of the bolt moves the operating arm.

16. The ammunition feed adapter of claim 14, further comprising a forward firearm mount assembly having a mount coupled to the body of the feed adapter and an adapter base attached to the gun.

17. The ammunition feed adapter of claim 1, wherein the action mechanism includes a bolt and the operating rod assembly attaches directly to the bolt.

18. The method according to claim 10, wherein the a belt puller assembly comprises a belt puller tray and wherein advancing the ammunition belt includes moving the ammunition belt linearly along a horizontal plane relative to the magazine-fed firearm along the belt puller tray.

* * * * *